US011471730B1

(12) United States Patent
Schweitzer

(10) Patent No.: US 11,471,730 B1
(45) Date of Patent: Oct. 18, 2022

(54) ISOMETRIC EXERCISE SYSTEM HAVING IMPROVED ACCURACY AND CONSISTENCY FOR APPLIED FORCE DETERMINATIONS

(71) Applicant: Robert A. Schweitzer, W. Hartford, CT (US)

(72) Inventor: Robert A. Schweitzer, W. Hartford, CT (US)

( * ) Notice: Subject to any disclaimer, the term of this patent is extended or adjusted under 35 U.S.C. 154(b) by 0 days.

(21) Appl. No.: 15/807,965

(22) Filed: Nov. 9, 2017

(51) Int. Cl.
*A63B 24/00* (2006.01)
*A63B 21/002* (2006.01)
*A63B 71/06* (2006.01)

(52) U.S. Cl.
CPC ..... *A63B 24/0062* (2013.01); *A63B 21/0023* (2013.01); *A63B 71/0622* (2013.01); *A63B 2220/50* (2013.01); *A63B 2225/50* (2013.01)

(58) Field of Classification Search
CPC ..... A63B 21/0023; A63B 24/0062; A63B 71/0622; A63B 2220/50; A63B 2225/50; A61B 5/22; A61B 5/224
See application file for complete search history.

(56) References Cited

U.S. PATENT DOCUMENTS 6,227,047 B1 * 5/2001 Livingston ..... G16H 20/30 73/379.08
2012/0040799 A1 * 2/2012 Jaquish ..... A63B 23/0355 482/9
2018/0369641 A1 * 12/2018 Saunders ..... A63B 23/04

* cited by examiner

*Primary Examiner* — Jennifer Robertson
(74) *Attorney, Agent, or Firm* — Mark C. Johnson; Johnson Dalal

(57) ABSTRACT

An isometric exercise system comprised of a network-enabled isometric exercise apparatus, force correction equations, and an isometric exercise companion software application. The isometric exercise apparatus can include force-receiving components, a measurement component, a pivot assembly, and a structural assembly. The measurement component can measure the amount of applied force. The pivot assembly can rotationally transfer the applied force to the measurement component. Force analysis of exercises can indicate that only a tangential component of the applied force is mechanically transferred to the measurement component via the pivot assembly. The force correction equations can translate the measured force into the tangential force transferred by the pivot assembly. The isometric exercise companion software application can present the amount of weight manipulated by the user to perform the exercise calculated using the force correction equation and the measured force. This calculation can have greater accuracy and consistency than utilizing the measured force.

13 Claims, 4 Drawing Sheets

ISOMETRIC EXERCISE SYSTEM HAVING IMPROVED ACCURACY AND CONSISTENCY FOR APPLIED FORCE DETERMINATIONS

BACKGROUND

The present invention relates to the field of isometric exercise systems, and more particularly to an isometric exercise system having improved accuracy and consistency for applied force determinations.

Exercise and exercise equipment or systems are popular in today's health-conscious society. A wide variety of exercise techniques or principles and equipment have come into and fallen out of favor with trainers and other proclaimed health gurus. Strength training, whether performed with weights or resistance, is still a popular component of many people's exercise regimen. A form of strength training that is still popular is performing isometric exercises.

Performing an isometric exercise often involves a significant amount of force, much more than one would be able to normally lift or move. Many isometric exercises represent a muscular action in which tension is developed without a contraction of the muscle, as occurs when using free weights. Therefore, many exercise apparatuses designed for the performance of isometric exercises utilize a load cell that can accommodate a wide range of applied/measured force. This allows the user to create different loads, relatively to the amount of force that they apply, without requiring the exercise apparatus to accommodate multiple weight or resistance components.

Unfortunately, the basic mechanical design of some of these conventional isometric exercise apparatuses imprecisely measures the force applied by a user. That is, the range in which the mechanical components of the conventional isometric exercise apparatus flex, rotate, and/or move is variable. This variability impacts the force measurement and the corresponding amount of force that the user generated (i.e., held, pulled, lifted, etc.) during performance of the isometric exercise. Different angles of applied force results in different loads on equipment components. It is possible for a user to apply the same amount of force in the performance of an isometric exercise on the same conventional isometric exercise apparatus in two separate repetitions and get two different force (or weight equivalent) readings. This variability (measurement inconsistency) is in addition to any measurement differences that exist between different types/brands of isometric exercise apparatuses.

Further, when calculating the amount of force provided by the user, conventional exercise apparatuses fail to acknowledge how the force applied by the user is transferred through the elements of exercise apparatus to the measurement component. That is, the force applied by the user is not mechanically transferred to the load cell through the exercise apparatus in its entirety, angles applicable to the force and structural components of the equipment affect the load measurements. Further, the amount of the transferred force varies based on the isometric exercise being performed, as the motion and location of the force-receiving component varies by exercise. Thus, additional inaccuracies are introduced into the force measurements, and their corresponding weight calculations, because these conventional exercise apparatuses ignore how each different isometric exercise transfers force to the measurement component.

Therefore, what is needed is a solution that takes into account how the force applied by the user during the performance of each different isometric exercise is transferred to the measurement component of the exercise apparatus. Such a solution would correct the force measurement of the exercise apparatus without modification to the exercise apparatus. This correction would then improve the accuracy and repeatability of the measurement of the actual force applied by the user as well as the correspondent weight calculation.

BRIEF SUMMARY

One aspect of the present invention can include an isometric exercise system comprised of a reconfigurable network-enabled isometric exercise apparatus, force correction equations, and an isometric exercise companion software application. The isometric exercise apparatus can be capable of measuring an amount of force applied by a user during the performance of an isometric exercise. The isometric exercise apparatus can include two or more force-receiving components, a measurement component, a pivot assembly, and a structural assembly. The user can apply force to one of force-receiving components during performance of the isometric exercise. The force-receiving component used can vary based on the isometric exercise being performed. The measurement component can be used to measure the amount of force applied by the user to the force-receiving component. The pivot assembly can be mechanically-coupled between the force-receiving components and the measurement component. The pivot assembly can rotationally transfer the force applied by the user to the force-receiving component to the measurement component. A force analysis of isometric exercises performed with the isometric exercise apparatus can indicate that only a tangential component of the force applied by the user to the force-receiving component is mechanically transferred to the measurement component via the pivot assembly. The structural assembly can couple the force-receiving components, the measurement component, and the pivot assembly into a machine usable for the performance of isometric exercises. The force correction equations can be derived from their respective force analysis. Each force correction equation can translate the amount of force measured by the measurement component into an amount of tangential force mechanically transferred to the measurement component via the pivot assembly. The isometric exercise companion software application can run on a computing device and can be configured to present to the user, via a display, a calculated amount of weight, correspondent to the amount of mechanically-applied tangential force, manipulated by the user to perform the isometric exercise. The calculation can utilize the force correction equation for the respective isometric exercise and the amount of applied force measured by the measurement component. The calculated amount of weight can be determined with greater accuracy and consistency than utilizing the amount of force measured by the measurement component. The user can select the isometric exercise to be performed within the isometric exercise companion software application prior to performance of the isometric exercise. In one embodiment, a set of actuators or servos can automatically adjust components of the isometric exercise equipment for a selected exercise. In another embodiment, a user can mechanically adjust components consistent with software application selected exercises. In manual reconfigurations/adjustments, the software can guide and train the user in a proper manner of adjusting the isometric exercise equipment for the selected exercise. Further, a series or sequence of exercises can be suggested through the software to minimize reconfiguration(s) while ensuring a complete full-body workout is provided to the user.

Another aspect of the present invention can include an isometric exercise system having a reconfigurable network-enabled isometric exercise apparatus and a computing device. The isometric exercise apparatus can be capable of measuring an amount of force applied by a user during the performance of an isometric exercise. The isometric exercise apparatus can include two or more force-receiving components, a measurement component, a pivot assembly, and a structural assembly. The user can apply force to one of force-receiving components during performance of the isometric exercise. The force-receiving component used can vary based on the isometric exercise being performed. The measurement component can be used to measure the amount of force applied by the user to the force-receiving component. The pivot assembly can be mechanically-coupled between the force-receiving components and the measurement component. The pivot assembly can rotationally transfer the force applied by the user to the force-receiving component to the measurement component. A force analysis of isometric exercises performed with the isometric exercise apparatus can indicate that only a tangential component of the force applied by the user to the force-receiving component is mechanically transferred to the measurement component via the pivot assembly. The structural assembly can couple the force-receiving components, the measurement component, and the pivot assembly into a machine usable for the performance of isometric exercises. The computing device can be comprised of a display, a non-transitory persistent storage medium for storing programmatic instructions, a means for exchanging data over a communications network, force correction equations, and a processing system. The force correction equations can be derived from their respective force analysis. Each force correction equation can translate the amount of force measured by the measurement component into an amount of tangential force mechanically transferred to the measurement component via the pivot assembly. The processing system can execute programmatic instructions to receive user-selection of the isometric exercise via a user interface. It can be assumed that the selected isometric exercise is to be performed using the isometric exercise apparatus. The force correction equation for the user-selected isometric exercise can then be retrieved. Via the communication means, the amount of force measured by the measurement component of the isometric exercise apparatus can be received. The received amount of force can be converted into the amount of tangential force using the retrieved force correction equation. Then the amount of equivalent weight manipulated during performance of the user-selected isometric exercise that corresponds to the amount of tangential force can be calculated. The calculated amount of equivalent weight can be determined with greater accuracy and consistency than utilizing the amount of force measured by the measurement component. The calculated amount of equivalent weight can then be presented within the display via the user interface. Equivalent weight refers to a translation of the force/load into an equivalent amount of free weight that would be manipulated by a selected equivalent exercise. For example, a bench press exercise may calculate the amount of weight that would be lifted upwards through application of a given force, even though the isometric exercise equipment is not lifting "weight" but is applying a load to a sensor based on the force generated by the user of the equipment.

Yet another aspect of the present invention can include a computer program product that includes a computer readable storage medium having embedded computer usable program code. The computer usable program code can be configured to receive user-selection of an isometric exercise via a user interface. It can be assumed that the selected isometric exercise is to be performed using a corresponding network-enabled isometric exercise apparatus. The isometric exercise apparatus can be capable of measuring an amount of force applied by a user against a force-receiving component during performance of the isometric exercise. A pivot assembly can rotationally transfer the force applied by the user to the measurement component. A force analysis of isometric exercises performed with the isometric exercise apparatus can indicate that only a tangential component of the force applied by the user to the force-receiving component is mechanically transferred to the measurement component via the pivot assembly. The computer usable program code can be configured to retrieve a force correction equation for the user-selected isometric exercise. Each force correction equation can be derived from their respective force analysis. Each force correction equation can translate the amount of force measured by the measurement component into an amount of tangential force mechanically transferred to the measurement component via the pivot assembly. The computer usable program code can be configured to receive the amount of force measured by the measurement component of the isometric exercise apparatus. The computer usable program code can be configured to convert the received amount of force into the amount of tangential force using the force correction equation. The computer usable program code can be configured to calculate an amount of equivalent weight manipulated during performance of the user-selected isometric exercise that corresponds to the amount of tangential force. The calculated amount of weight can be determined with greater accuracy and consistency than utilizing the amount of force measured by the measurement component. The computer usable program code can be configured to present the calculated amount of equivalent weight within the user interface. The user interface may additionally show force applied and/or load sensed. Also, in one embodiment, the user interface can show a relative value based on past exercise behavior of a specific user so that the user is able to gauge relative improvement regardless of the deltas in equivalent weight.

DETAILED DESCRIPTION

Figure 1:
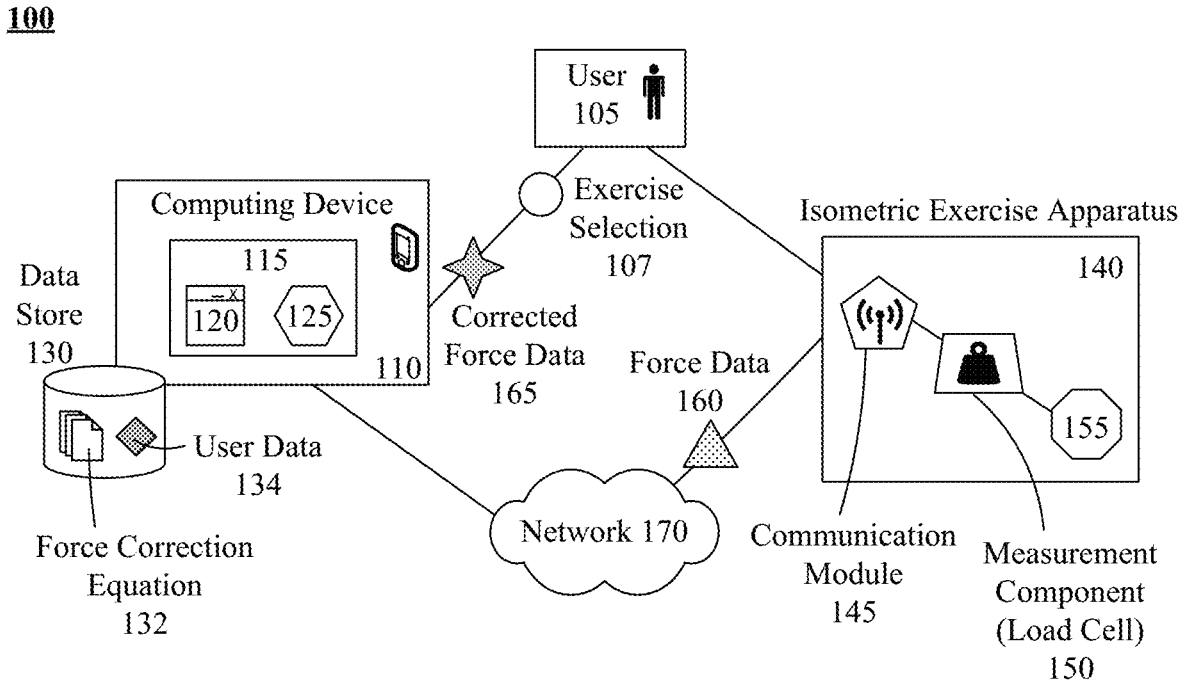
FIG. 1 is an illustration of a system that increases the accuracy of the calculated amount of equivalent weight manipulated by the user when performing an isometric exercise using the isometric exercise apparatus in accordance with embodiments of the inventive arrangements disclosed herein.

Embodiments of the disclosed invention can present a solution that improves the calculation of the force applied by a user during the performance of an isometric exercise using a network-enabled isometric exercise apparatus. An isometric exercise is a type of strength exercise where the user holds the maximum "weight" that they can handle in the strongest point of their range of motion for a short amount of time (typically 5-10 seconds) or until muscle failure for a single repetition. For example, if the user would normally bench press 150 pounds, they would perform the isometric exercise equivalent using an equivalent weight around 300 pounds. This equivalent weight would be held at the strongest point of the bench press motion, about two to three inches before being able to lock elbows. The equivalent weight is really a force being applied to a relatively component of the isometric exercise equipment. In an isometric exercise joint angle and muscle length do not change during contraction compared to concentric or eccentric contractions that are referred to as dynamic/isotonic movements. Isometric exercises are performed in static positions, rather than being dynamic through a range of motion.

A variety of exercise apparatuses can be used to perform isometric exercises. The basic mechanical design of such exercise apparatuses utilizes a means for measuring the amount of force that the user exerts, typically a load cell. Advanced versions of this type of equipment include the means to present the user with a measure of an amount of equivalent weight that they are manipulating (i.e., lifting, pushing, pulling, holding) correspondent to the force they apply. These existing exercise apparatuses utilize the force applied by the user, as measured by the measurement component, to calculate how much force and correspondent weight that the user is manipulating while performing the isometric exercise. This calculation, however, is flawed as only a portion of the amount of force applied by the user is actually mechanically transferred to the measurement component through the mechanical components of the exercise apparatus. That is, existing calculations do not take into account how the force applied by the user travels through the elements of exercise apparatus to reach the measurement component, which also varies based on the isometric exercise being performed.

Further, the mechanical design of many of these exercise apparatuses is unable to provide precise and consistent measurements of the force applied by the user. That is, the mechanical components of the exercise apparatus have a range of variability dependent on user position, equipment configuration, and other factors. This variability impacts the force measurement and the corresponding amount of equivalent weight that the user manipulated (i.e., held, pulled, lifted, etc.) during performance of the isometric exercise. It is possible for a user to apply the same amount of force in the performance of an isometric exercise on the same exercise apparatus in two separate repetitions and get two different force/weight readings. This variability is in addition to any measurement differences that exist between different types/brands of exercise apparatuses. As users often utilize weight equivalents as a baseline to determine exercise effectiveness and/or as a target to push themselves to achieve during exercise routines, accurate calculation of weight equivalent is a significant factor towards user satisfaction with isometric exercise equipment.

Thus, the present invention analyzes how the force applied by the user during the performance of each different isometric exercise to determine its correction to the force measured by the measurement component. These force correction equations can then be used to provide consistent and repeatable calculations of the amount of corresponding weight, without modifying the exercise equipment or its measurement component.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 is an illustration of an exercise system 100 that increases the accuracy of the calculated amount of weight manipulated by the user 105 when performing an isometric exercise using the isometric exercise apparatus 140 in accordance with embodiments of the inventive arrangements disclosed herein. In system 100, a user 105, a person, can utilize an isometric exercise apparatus 140, herein referred to as the exercise apparatus 140, to perform an isometric exercise. As is well known in the Art, an isometric exercise is a type of isometric exercise where the user holds the maximum weight that they can handle in the strongest point of their range of motion for a short amount of time (typically 5-10 seconds) or until muscle failure for a single repetition.

Figure 1A:
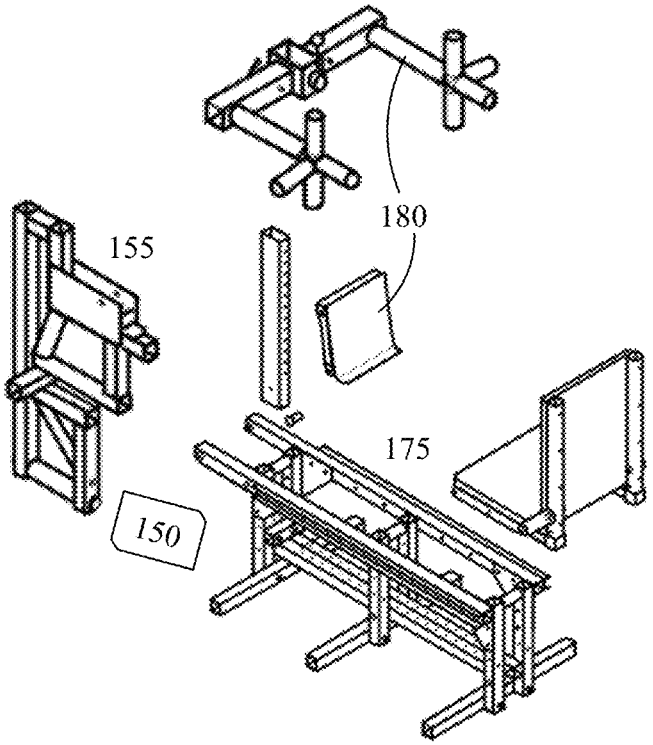
FIG. 1A is an exploded view of the basic components of an isometric exercise apparatus in accordance with embodiments of the inventive arrangements disclosed herein.

The exercise apparatus 140 can represent a piece of equipment that allows the performance of an isometric exercise, as is known in the Art. An example embodiment of exercise apparatus 140 can be shown in FIG. 1A. In general, the exercise apparatus 140 can be comprised of a structural assembly 175 that couples one or more force-receiving components 180 to a pivot assembly 155. A force-receiving component 180 can represent an element that the user 105 applies force to perform the isometric exercise. The force-receiving component 180 utilized by the user 105 can vary based on the specific isometric exercise being performed. As presented in the example embodiment, the force-receiving component 180 for a chest press can be the bar, whereas the plate-like force-receiving component would be used for a leg press.

The structural assembly 175 can represent the body of the exercise apparatus 140. The structural assembly 175 can provide a stable support for the force-receiving components 180, pivot assembly 155, measurement component 150, and other elements. The structural assembly 175, pivot assembly 155, and force-receiving components 180 can be made from a variety of materials suitable for the rigors of isometric exercises, as are well known in the Art.

A pivot assembly 155 can be a set of mechanical elements that transfer the force applied by the user 105 to the force-receiving component 180 to the measurement component 150. The pivot assembly 155 can provide a consistent means for transferring this force regardless of which force-receiving component 180 is used, unlike many conventional exercise apparatuses. That is, no matter how the user 105 applies force to any of the force-receiving components 180, the pivot assembly 155 can always perform the same rotational motion to transfer that force to the measurement component 150.

The measurement component 150 can be the element of the exercise apparatus 140 that measures the amount of force applied by the user 105 when the isometric exercise is performed. The most common example of a measurement component 150 used in such an exercise apparatus 140 can be a load cell; the specific type of load cell used can vary based upon requirements and/or implementation. The measurement component 150 can be coupled to the pivot assembly 155 and housed in and/or attached to the structural assembly 175. When the user 105 applies force to a force-receiving component 180, the measurement component 150 can measures the amount of applied force that is transferred via the pivot assembly 155 as force data 160.

Additionally, the exercise apparatus 140 can include a communication module 145. The communication module 145 can represent the means by which the exercise apparatus 140 communicates with a computing device 110 over a network 170, particularly to convey force data 160. Many conventional exercise apparatuses 140 can lack network 170 communications capabilities. The communication module 145 can utilize wired and/or wireless technologies as well as standard communications protocols. The communication module 145 can be coupled with the measurement component 150 in a single housing for attachment to the structural assembly 175. Alternatively, the communication module 145 can be installed in an area of the structural assembly 175, separate from the measurement component 150.

It is imperative to emphasize the benefit of the pivot assembly 155 with regards to force measurements. In essence, the pivot assembly 155 can standardize how the force applied to a force-receiving component 180 is transferred to the measurement component 150. This standardization can greatly improve the consistency in which the force measurements are made by the same exercise apparatus 140 as well as across multiple exercise apparatuses 140. That is, if the same amount of force is applied in two separate repetitions of the same isometric exercise, the exercise apparatus 140 would produce identical (within accepted tolerances) force measurements, unlike many conventional exercise apparatuses.

In many conventional exercise apparatuses, their force-receiving components 180 can be directly connected to the measurement component 150. This means that a conventional exercise apparatus treats forces applied using different motions, even in different directions, as the same type of measurement. This can be a flawed application of physics (mechanics) because the force vector of the applied force is typically not the same as the force vector received by the measurement component 150, due to physical mechanical components.

Further, the mechanical components of conventional exercise apparatuses can have a wide range in which they flex, rotate, and/or move every time the user 105 performs an isometric exercise. This variability can impact the force data 160 measured by the measurement component 150 and the corresponding amount of weight that the user manipulated (i.e., held, pulled, lifted, etc.) during performance of the isometric exercise. Thus, it can be possible for a user 105 to apply the same amount of force in the performance of an isometric exercise on two identical conventional exercise apparatus and get two different force/weight readings.

It can be preferred for the exercise apparatus 140 to be reconfigurable so as to accommodate various configurations that allow different isometric exercises to be performed. Further, additional elements like force-receiving components 180 can be added to increase the type of isometric exercises supported. In one embodiment, the reconfigurable components are manually reconfigurable by a user. In another embodiment, a set of actuators or servos are used to automatically adjust equipment components for the different configurations. Use of the software application 115 and selection of specific exercises via the application 115 can trigger the servos to adjust components of the exercise apparatus 140 in servo/actuator equipped embodiments.

The computing device 110 can be an electronic device capable of running an isometric exercise companion software application 115, herein referred to as the companion application 115, and communicating with the communication module 145 of the exercise apparatus 140 over the network 170. Examples of the computing device 110 can include, but are not limited to, a smartphone, a notebook computer, a tablet computer, a desktop computer, a laptop computer, a computer kiosk, a specialized electronic device, and the like.

In one contemplated embodiment, the computing device 110 can be owned by the user 105. In such an embodiment, the user 105 can bring the computing device 110 with when using the exercise apparatus 140. This embodiment can be preferred as all data collected and used by the companion application 115 regarding the user's 105 performance can be stored local to the computing device 110.

In another embodiment, the computing device 110 can be an integrated component of the exercise apparatus 140, similar to existing exercise equipment that have integrated and/or interactive displays. In still another contemplated embodiment, the computing device 110 can be permanently installed proximate to the exercise apparatus 140. For example, in a large exercise gym (e.g., GOLD'S GYM), multiple exercise apparatuses 140 can be installed on the gym floor, each having a connected computer kiosk 110 for using the companion application 115.

The companion application 115 can be a software program designed to be used in conjunction with the exercise apparatus 140 to provide the user 105 with corrected force data 165 that increases the accuracy of the calculation of the corresponding weight that the user 105 manipulates during their performance of an isometric exercise. As used herein, the term "manipulate", with respect to the performance of an isometric exercise, can refer to the specific motion and/or position that the user 105 utilizes when applying force to the exercise apparatus 140, such as lifting, pulling, pushing, or holding. Since the specific term varies based on the particular exercise being performed, the term "manipulate" is used, herein, as an umbrella term to encompass the exercise-specific terms.

The companion application 115 can include a user interface 120, a force conversion module 125, and a data store 130 for storing force correction equations 132 and user data 134. The user interface 120 can represent the means by which the user 105 can interact with the companion application 115, such as to provide an exercise selection 107. The user interface 120 can include a graphical user interface (GUI) as well as physical interactive elements of the computing device 110 (e.g., display, buttons, switches, knobs, etc.). As is common in the Art, the user interface 120 can be used to capture entered data like user data 134 and present data generated by the companion application 115 to the user 105.

In one embodiment, the exercise selection 107 can simply indicate the isometric exercise that the user 105 is going to perform using the exercise apparatus 140. It can be assumed that the user 105 has configured the exercise apparatus 140 for the exercise selection 107. Since the exercise apparatus 140 is "dumb" (i.e., cannot determine what exercise is being performed) in embodiments, an incorrect exercise selection 107 by the user 105 can result in inaccurate calculations and results.

In an actuator/servo equipped embodiment, components of the exercise apparatus 140 can be automatically adjusted/configured by the servos. In such an embodiment, the exercise selection 107 results in the actuator(s)/servo(s) being adjusted, this results in the apparatus 140 being automatically configured for an app/software selected exercise. Actuator/Servo based adjustments may also be customized for a specific end-user, so that positions of components are adjusted based on a specific end-user's size/preference.

In another embodiment, a set of sensors are present in the exercise equipment 140, which indicates which exercise an end user is performing. For example, a camera can capture a user's position in the exercise apparatus 140, which can be conveyed to the computing device 110 and software and used to adjust the exercise based on actual user activity on the apparatus 140. Pressure sensors (applied to different components of the apparatus 140) can be utilized as sensors, as pressure applied to sensors is also indicative of which of a set of exercises is being performed (in which case no camera and image recognition is necessary). Accordingly, different embodiments contemplate relatively "dumb" interactions between the apparatus 140 and the application 115, application driven adjustments of the apparatus 140 to facilitate configurations, and/or automated changes to the application 115 based on sensors readings during use of the apparatus 140.

The user data 134 can be a collection of data elements about the user 105. The user data 134 can also be used to store force data 160 and/or corrected force data 165. Additionally, the user data 134 can store the user's 105 preferences for the companion application's 115 available configurable parameters. The specific data elements collected in the user data 134 can vary based upon the features supported by the specific implementation of the companion application 115. For example, if the companion application 115 is designed to provide the user 105 with comparisons of their workout data with workout data for other similar users, the user data 134 can include data elements for age, height, weight, and gender for the user 105 to provide values.

The force conversion module 125 can represent the elements of the companion application 115 that handle the translation of the force data 160 received from the exercise apparatus 140 into corrected force data 165 using the force correction equations 132. A force correction equation 132 can be an expression that corrects the force data 160, as measured by the measurement component 150, for the mechanical transference to the measurement component 150. That is, only a portion of the force applied by the user 105 to the force-receiving component of the exercise apparatus 140 can be transferred through the mechanical elements to the measurement component 150.

Many, if not most, conventional exercise apparatuses 140 can measure the amount of force and/or correspondent weight manipulated by the user 105 during performance of an isometric exercise. However, these existing exercise apparatuses 140 utilize the force applied by the user 105, as measured by the measurement component 150, for their calculation. As previously discussed, this approach (of using the measured force for this calculation) can be based on a flawed premise—that all the forces applied by the user 105 to the force-receiving components 180 are equal and is completely transferred to the measurement component 150.

The approach taught by the present invention can correct for this inaccuracy by using a force correlation equation 132 that is derived from an analysis of the mechanics and force transference from the force-receiving component 180 through the pivot assembly 155 to the measurement component 150 for each isometric exercise (as each exercise utilizes a different motion and/or configuration of the exercise apparatus 140). This process can be discussed in further detail in FIG. 4.

The corrected force data 165 can then be used by the companion application 115 as is or to calculate the correspondent amount of weight that was manipulated by the user 105 during the exercise (such conversions are well known in the Art). Further, the corrected force data 165 and/or its corresponding weight can be stored in the user data 134. This historical archive of corrected force data 165 and/or weight can be used by the companion application 115 to generate charts and/or graphs of the user's 105 performance over time as well as for other features as desired.

In another contemplated embodiment, the force conversion module 125 of the companion application 115 and/or the force correlation equations 132 can be embedded within the exercise apparatus 140. The user 105 would still access the user interface 120 of the companion application 115 to enter their exercise selection 107 and view their corrected force data 165. Such an embodiment can require more communication between the computing device 110 and the exercise apparatus 140.

As used herein, presented data store 130 can be a physical or virtual storage space configured to store digital information. Data store 130 can be physically implemented within any type of hardware including, but not limited to, a magnetic disk, an optical disk, a semiconductor memory, a digitally encoded plastic memory, a holographic memory, or any other recording medium. Data store 130 can be a stand-alone storage unit as well as a storage unit formed from a plurality of physical devices. Additionally, information can be stored within data store 130 in a variety of manners. For example, information can be stored within a database structure or can be stored within one or more files of a file storage system, where each file may or may not be indexed for information searching purposes. Further, data store 130 can utilize one or more encryption mechanisms to protect stored information from unauthorized access.

Network 170 can include any hardware/software/and firmware necessary to convey data encoded within carrier waves. Data can be contained within analog or digital signals and conveyed though data or voice channels. Network 170 can include local components and data pathways necessary for communications to be exchanged among computing device components and between integrated device components and peripheral devices. Network 170 can also include network equipment, such as routers, data lines, hubs, and intermediary servers which together form a data network, such as the Internet. Network 170 can also include circuit-based communication components and mobile communication components, such as telephony switches, modems, cellular communication towers, and the like. Network 170 can include line based and/or wireless communication pathways.

Figure 2:
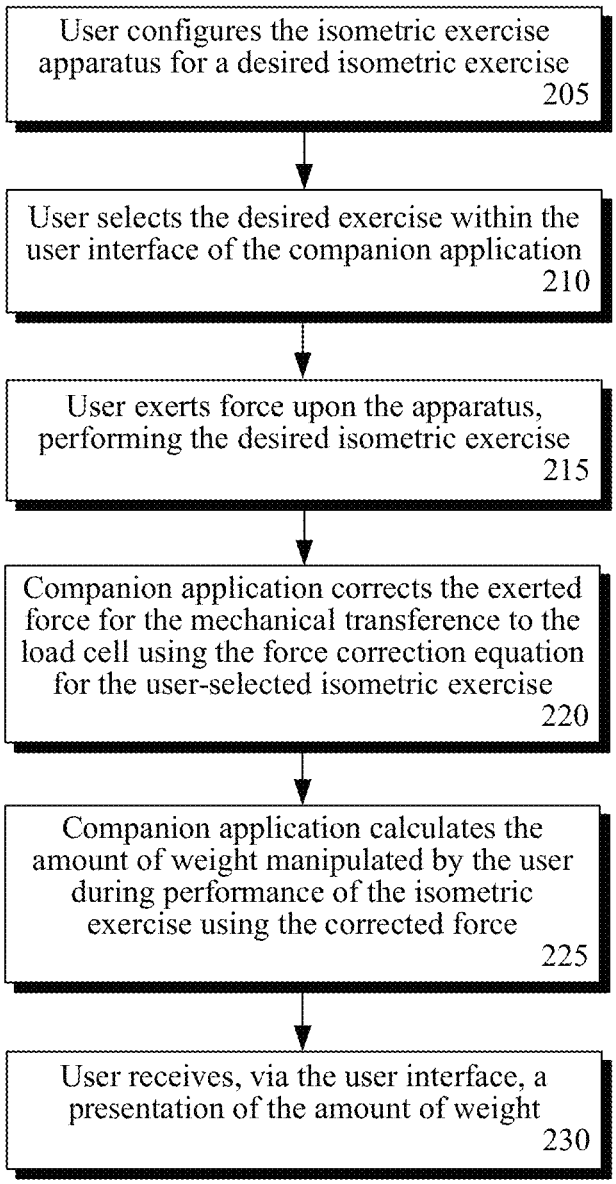
FIG. 2 is a flowchart of a method describing the general use of an isometric exercise system that provides user force/weight calculations with improved accuracy consistency in accordance with embodiments of the inventive arrangements disclosed herein.

FIG. 2 is a flowchart of a method 200 describing the general use of an isometric exercise system that provides user force/weight calculations with improved accuracy in accordance with embodiments of the inventive arrangements disclosed herein. Method 200 can be performed within the context of system 100 and/or using the embodiment of FIG. 1A.

Method 200 can begin with step 205 where the user configures the exercise apparatus for the isometric exercise that they wish to perform. It should be noted that the exercise apparatus described in method 200 can be the preferred embodiment, which is reconfigurable to allow the user to perform a variety of isometric exercise with one piece of equipment.

The user can then select the desired isometric exercise within the user interface of the companion application in step 210. It can be important to emphasis that, like many software tools, the validity of the data provided to the user by the companion application relies upon the integrity of the data entered by the user. That is, if the user selects an isometric exercise in the companion application different than the one they perform, the calculations of the companion application will be invalid. Contemplated embodiments of the exercise apparatus can include sensors to determine its configuration to verify the user's isometric exercise selection. Other contemplated embodiments utilize actuators/servos to adjust the configuration of the exercise apparatus to match a software selected exercise.

The companion application can be running on a computing device that is proximate to the exercise apparatus so as to establish a communications pathway between the computing device and the communication module of the exercise apparatus. This proximate distance can vary based upon the type of communications network and/or hardware used in the specific embodiment. Depending upon the specific implementation of the present invention, the computing device can be owned by the user or by an owner of the exercise apparatus (when the owner is not the user) that the user is allowed access. Further, the computing device can be an integrated component of or coupled to the exercise apparatus. Alternatively, the computing device can be a portable device like a smartphone.

In step 215, the user can then perform their desired isometric exercise by exerting force upon the appropriate force-receiving component of the exercise apparatus. The companion application can then correct the exerted force measured by the measurement component of the exercise apparatus to account for the mechanical transference of the force to the measurement component of the exercise apparatus via the pivot assembly in step 220. The correction performed in step 220 can utilize the force correction equation developed from a force analysis of the specific isometric exercise.

In step 225, the companion application can calculate the amount of weight correspondent to the corrected force that the user manipulated during their performance of the isometric exercise. The user can then receive, via the user interface, a presentation of the amount of weight that they manipulated when performing the isometric exercise. This presentation can also include historical weight data to provide a graph or chart of the user's performance over time. Should the user prefer to use/see the corrected force data instead of the correspondent weight, step 225 can be omitted and the corrected force data used in step 230.

Figure 3:
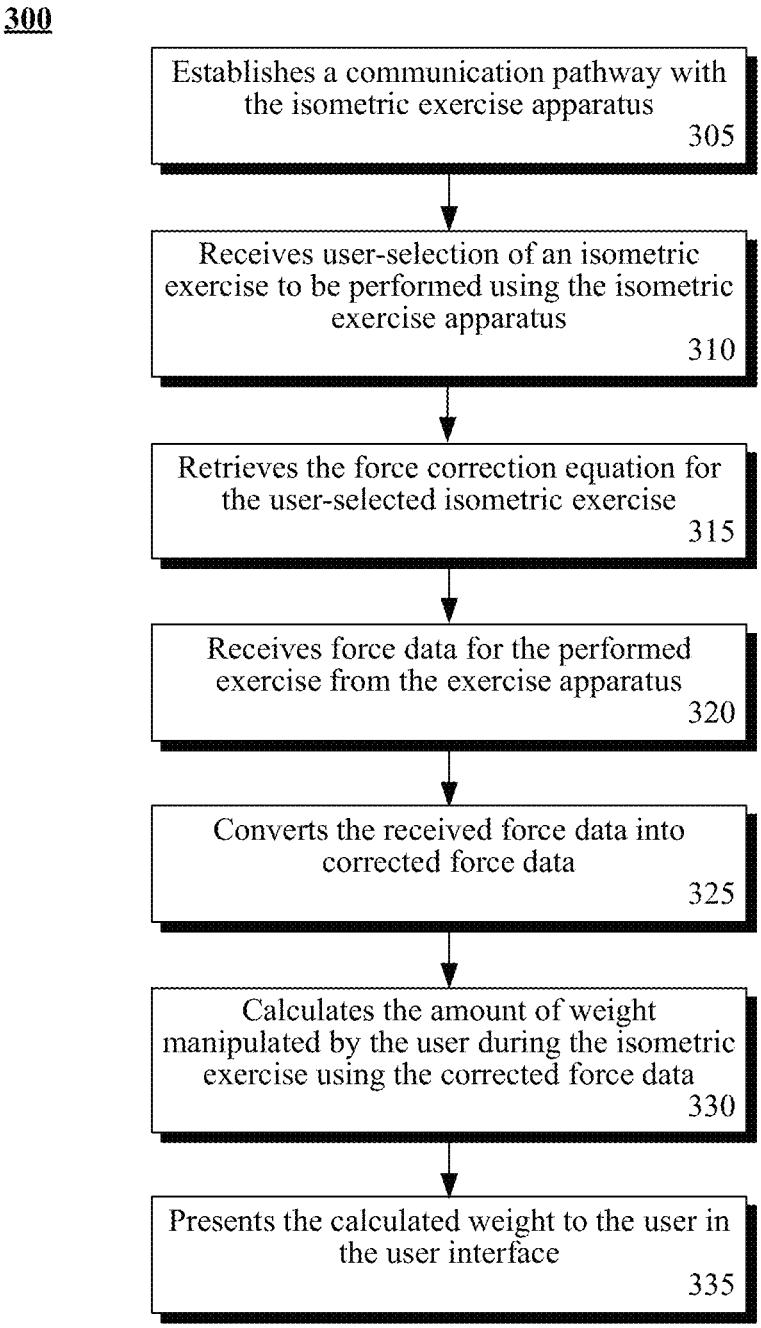
FIG. 3 is a flowchart of a method detailing operation of the companion application in accordance with embodiments of the inventive arrangements disclosed herein.

FIG. 3 is a flowchart of a method 300 detailing operation of the companion application in accordance with embodiments of the inventive arrangements disclosed herein. Method 300 can be performed within the context of system 100, method 200, and/or using the embodiment of FIG. 1A.

Method 300 can begin with step 305 where the companion application establishes a communication pathway with the exercise apparatus. User-selection of the isometric exercise to be performed using the exercise apparatus can be received in step 310.

In step 315, the force correction equation for the user-selected isometric exercise can be retrieved. The location from where the force correction equation is retrieved can vary based upon the specific architecture and/or implementation of the companion application. For example, the companion application can be a cloud service where the force correction equations are stored on a cloud server that is accessed over the network. In another example, the force correction equations can be data included with the companion application; the force correction equations can be stored locally on the computing device.

The force data for the performed isometric exercise can be received from the exercise apparatus in step 320. It should be noted that the received force data can be uncorrected. That is, the force data of step 320 can be as measured by the measurement component of the exercise apparatus without correction or other manipulation (i.e., raw data).

In step 325, the received force data can be converted into corrected force data using the appropriate force correction equation. The corrected force data can then be used in step 330 to calculate the amount of weight manipulated by the user during their performance of the isometric exercise. In step 335, the calculated weight can be presented to the user in the user interface. Again, should the user prefer to use/see the corrected force data instead of the correspondent weight, step 330 can be omitted and the corrected force data used in step 335.

Figure 4:
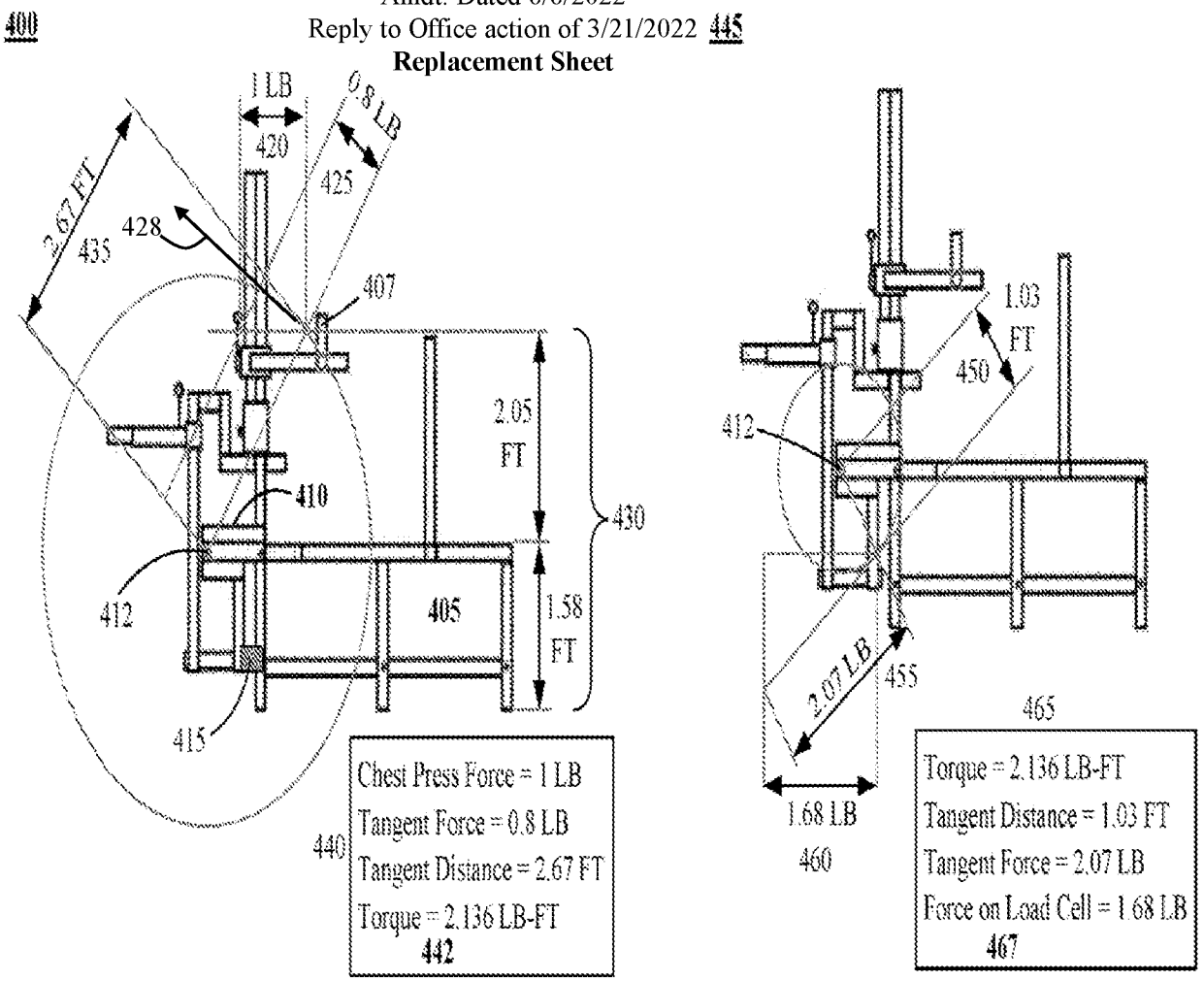
FIG. 4 presents illustrations showing the force analysis of a chest press isometric exercise performed using the isometric exercise apparatus in accordance with embodiments of the inventive arrangements disclosed herein.

FIG. 4 presents illustrations 400 and 445 showing the force analysis of a chest press isometric exercise performed using the exercise apparatus 405 in accordance with embodiments of the inventive arrangements disclosed herein. This type of force analysis can be performed for each isometric exercise supported by the exercise apparatus 405 derive the force correction equations taught by the present invention.

Illustration 400 can depict the exercise apparatus 405 in a configuration for a chest press isometric exercise. Performance of a chest press can require the user to be in a seated position and apply a horizontal force 420 against an appropriately positioned force-receiving component 407. To simplify the calculations of this analysis, application of a one pound (1 LB) horizontal force 420 can be used.

The 1 LB force 420 applied by the user to the force-receiving component 407 can invoke movement within the pivot assembly 410. The pivot assembly 410 can rotate around a pivot point 412 and engage the load cell 415. Because the pivot assembly 410 rotates, all of the horizontal force 420 applied by the user cannot be transferred to the load cell 415. Using the principles of physics and rotational mechanics, it can be determined that only the tangential component 428 of the 1 LB horizontal force 420 is transferred to the load cell 415. This analysis can indicate that only 80% (0.8 LB 425) of every 1 LB of horizontal force 420 applied in a chest press is transferred to the pivot assembly 410.

Because the pivot assembly 410 rotates, the 0.8 LB 425 applied by the user can generate a rotational force or torque 442 upon the pivot point 412. Torque 442 can be measured in units of force per distance. Since we already know the amount of force (0.8 LB 425), the amount of torque 442 can be calculated by multiplying the tangential force 425, 0.8 LB, by the tangential distance 435 traveled, 2.67 FT. The tangential distance 435 can be calculated using mathematical techniques known in the Art and the height measurements 430 of the exercise apparatus 405.

This calculation can indicate that the user's applied tangential force 425 produces 2.136 LB-FT of torque 442 on the pivot assembly 410, as shown in inset 440. Because the pivot assembly 410 is itself a machine, the pivot assembly 410 can rotate in response to the applied torque 442 to exert a secondary force 467 upon the load cell 415, as presented in illustration 445.

In illustration 445, the amount of force on the load cell 467 can be calculated in a reverse manner than the calculation of the torque 442 on the pivot assembly 410. Since we already know the torque 442, if we multiply the torque 442 by the tangential distance 450 that the pivot assembly 410 travels to the load cell 415 (which is omitted from illustration 445 for clarity reasons; however, it is still in the same location as illustration 400), then we can determine the amount of tangential force 455 is being applied by the pivot assembly 410 to the load cell 415.

The tangential distance 450 can be a known (i.e., measured) value of 1.03 FT. Therefore, the tangential force 455 transferred to the load cell 415 by a torque 442 of 2.136 LB-FT can be calculated as 2.07 LB. Like the force-receiving component 407, the load cell 415 can be horizontally positioned, which means that it is the horizontal component of the tangential force 455 that is applied to the load cell 415. Using the same mathematical techniques as the calculations of illustration 400, it can be determined that the horizontal force 460 applied by the pivot assembly 410 to the load cell 415 is 1.68 LB, as shown in inset 465.

Therefore, it can be determined that every 1 LB of horizontal force 420 applied by the user to the force-receiving component 407 when performing a chest press is actually 1.68 LB 467 of force at the load cell 415. The values 440 and 465 determined from this force analysis can be the basis of the force correlation equation used for the chest press exercise by the companion application.

It should be further emphasized that the pivot assembly 410 can be a standardized intermediary component of the exercise apparatus 405, and, as such, the same force correlation equations can be used with any of these exercise apparatuses 405. That is, a user using the companion application can be confident that using an exercise apparatus 405 in Gym A will provide them with the same measurement results as the exercise apparatus 405 they have at home (for the same exercise). Conventional exercise apparatuses can lack this level of consistency.

The diagrams in the Figures illustrate the architecture, functionality, and operation of possible implementations of systems and methods according to various embodiments of the present invention. It will also be noted that each block of the block diagrams and combinations of blocks in the block diagrams can be implemented by special purpose hardware-based systems that perform the specified functions or acts, or combinations of special purpose hardware and computer instructions.

What is claimed is:

1. An isometric exercise system comprising:

a reconfigurable network-enabled isometric exercise apparatus capable of measuring an amount of force applied by a user during performance of an isometric exercise, said isometric exercise apparatus comprises:

at least two force-receiving components where the user applies force to one of the at least two force-receiving components during performance of the isometric exercise, wherein a force-receiving component used varies based on the isometric exercise being performed;

a measurement component for measuring the amount of force applied by the user to the force-receiving component;

a pivot assembly mechanically coupled between the at least two force-receiving components and the measurement component, wherein said pivot assembly is operably configured to rotationally transfer the force applied by the user to the force-receiving component to the measurement component to generate an amount of mechanically-applied tangential force during the performance of the isometric exercise applied by the user to the force-receiving component mechanically transferred to the measurement component via the pivot assembly; and a structural assembly for coupling the at least two force-receiving components, the measurement component, and the pivot assembly into a machine usable for the performance of isometric exercises;

a plurality of force correction equations each configured to translate the amount of force measured by the measurement component into the amount of mechanically-applied tangential force; and an isometric exercise companion software application running on a computing device and configured to present to the user, via a display, a calculated amount of weight, correspondent to the amount of mechanically-applied tangential force, manipulated by the user to perform the isometric exercise, wherein said calculation utilizes a force correction equation from the plurality of force correction equations for the respective isometric exercise and the amount of applied force measured by the measurement component, wherein the user selects the isometric exercise to be performed within the isometric exercise companion software application prior to performance of the isometric exercise.

2. The exercise system of claim 1, wherein the computing device is one of a smartphone, a laptop computer, a computer kiosk, a tablet computer, a notebook computer, and specialized electronic device.

3. The exercise system of claim 1, wherein the computing device is one of coupled to or an integrated component of the isometric exercise apparatus.

4. The exercise system of claim 1, wherein the measurement component is a load cell.

5. The exercise system of claim 1, wherein the isometric exercise companion software application further comprises:

a user interface configured to receive user-selection of the isometric exercise and present the calculated amount of weight within the display of the computing device.

6. The exercise system of claim 5, wherein the isometric exercise companion software application is further configured to store at least one of the amount of measured force and the calculated amount of weight over time in order to generate a chart or a graph of the at least one of the amount of measured force and the calculated amount of weight over time for presentation in the user interface.

7. The exercise system of claim 1, wherein the isometric exercise companion software application interacts with one of an online exercise system/service, an online health monitoring system/service, and an online medical system/service.

8. The exercise system of claim 1, wherein the isometric exercise companion software application is a cloud service.

9. An isometric exercise system comprising:

a reconfigurable network-enabled isometric exercise apparatus capable of measuring an amount of force applied by a user during performance of an isometric exercise, said isometric exercise apparatus comprises:

at least two force-receiving components where the user applies force to one of the at least two force-receiving components during performance of the isometric exercise, wherein a force-receiving component used varies based on the isometric exercise being performed;

a measurement component for measuring the amount of force applied by the user to a force-receiving component;

a pivot assembly mechanically coupled between the at least two force-receiving components and the measurement component, wherein said pivot assembly is operably configured to rotationally transfer the force applied by the user to the force-receiving component to the measurement component to generate an amount of mechanically-applied tangential force during the performance of the isometric exercise applied by the user to the force-receiving component mechanically transferred to the measurement component via the pivot assembly;

a structural assembly for coupling the at least two force-receiving components, the measurement component, and the pivot assembly into a machine usable for the performance of isometric exercises; and a computing device comprising:

a display;

a non-transitory persistent storage medium for storing programmatic instructions;

a means for exchanging data over a communications network;

a plurality of force correction equations each configured to translate the amount of force measured by the measurement component into the amount of mechanically-applied tangential force mechanically transferred to the measurement component via the pivot assembly;

a processing system operably coupled to the non-transitory persistent storage medium and the means for exchanging data over the communications network, said processing system executing programmatic instructions to:

receive user-selection of the isometric exercise via a user interface, wherein it is assumed that the selected isometric exercise is to be performed using the network-enabled isometric exercise apparatus;

retrieve one of the plurality of force correction equations for the user-selected isometric exercise;

receive, via the means for exchanging data over the communications network, the amount of force measured by the measurement component of the isometric exercise apparatus;

convert the received amount of force into the amount of tangential force using the retrieved force correction equation;

calculate an amount of weight manipulated during performance of the user-selected isometric exercise that corresponds to the amount of tangential force; and present the calculated amount of weight within the display via the user interface.

10. The exercise system of claim 9, wherein the computing device is one of a smartphone, a laptop computer, a computer kiosk, a tablet computer, a notebook computer, and specialized electronic device.

11. The exercise system of claim 9, wherein the computing device is one of coupled to or an integrated component of the isometric exercise apparatus.

12. The exercise system of claim 9, wherein the measurement component is a load cell.

13. The exercise system of claim 9, wherein the processing system executes programmatic instructions to:

maintain a historical archive of at least one of the amount of measured force and the calculated weight within the persistent storage medium;

generate at least one of a graph and a chart that represents the at least one of the amount of measured force and the calculated weight over a time period of the historical archive; and present the generated at least one of the graph and the chart within the display via the user interface.

* * * * *